US006079962A

United States Patent [19]

Seibel et al.

[11] Patent Number: 6,079,962

[45] Date of Patent: Jun. 27, 2000

[54] COMPOSITE ALUMINUM ALLOY SCROLL MACHINE COMPONENTS

[75] Inventors: Stephen M. Seibel, Celina; Marc J. Scancarello, Troy, both of Ohio

[73] Assignee: Copeland Corporation, Sidney, Ohio

[21] Appl. No.: 08/823,600

[22] Filed: Mar. 25, 1997

[51] Int. Cl.[7] ..... F01C 1/04

[52] U.S. Cl. ..... 418/55.2; 418/55.3; 418/55.5; 418/152; 418/179

[58] Field of Search ..... 418/55.2, 55.3, 418/55.4, 55.5, 152, 179

[56] References Cited

U.S. PATENT DOCUMENTS

| | | | |
|---|---|---|---|
| 4,767,293 | 8/1988 | Caillat et al. | 418/55.5 |
| 4,959,276 | 9/1990 | Hagiwara et al. | 428/614 |
| 5,076,772 | 12/1991 | Fraser, Jr. et al. | 418/55.5 |
| 5,104,302 | 4/1992 | Richardson, Jr. | 418/55.5 |
| 5,320,506 | 6/1994 | Fogt | 418/55.3 |
| 5,392,512 | 2/1995 | Fann et al. | 418/55.2 |
| 5,411,384 | 5/1995 | Bass et al. | 418/55.1 |
| 5,478,219 | 12/1995 | Nardone et al. | 418/55.2 |
| 5,492,460 | 2/1996 | Takeda et al. | 418/55.2 |
| 5,580,401 | 12/1996 | Williamson | 418/55.2 |

FOREIGN PATENT DOCUMENTS

| | | | |
|---|---|---|---|
| 0 567 284 B1 | 4/1993 | European Pat. Off. . | |
| 57-99202 | 6/1982 | Japan . | |
| 62-26391 | 2/1987 | Japan | 418/152 |
| 63-100293 | 5/1988 | Japan | 418/55.2 |
| 2245490 | 10/1990 | Japan | 418/55.2 |
| 3130591 | 6/1991 | Japan | 418/152 |
| 4203282 | 7/1992 | Japan | 418/55.2 |
| 5231348 | 9/1993 | Japan | 418/55.2 |
| 6-137287 | 5/1994 | Japan . | |

OTHER PUBLICATIONS

English translation of Japanese Unexamined Patent Application Publication No. 3–130591, Nagakazu Sakai, Matsushita Refrigeration Co., filed Oct. 13, 1989.

"Introducing Inco GrA–Ni™" presented at 1996 ASM/TMS Materials Week Conference (Oct. 8–10, 1996).

Bell, J.A.E.; Warner, A.E.M.; Stephenson, T.F.; Siegrist, E., "Some Automotive Applications For Cast Graphitic Aluminum Nickel Silicon Carbide MMC", Proceedings of Materials Week 1996, joint TMS/ASM Conference, Cincinnati, Ohio, Oct. 8–10, 1996.

Stephenson, T.F.; Warner, A.E.M.; Wilson, S.; Alpas, A.T.; Rohatgi, P.K., "Aluminum Hybrid Composites Containing Nickel–Coated Graphite Particulate", Proceedings of Materials Week 1996, joint TMS/ASM Conference, Cincinnati, Ohio, October 8–10, 1996.

Rohatgi, P.K.; Ray, S.; Liu, Y., "Tribological properties of metal matrix–graphite particle composites", *International Materials Reviews*, 1992, vol. 37, No. 3, pp. 129–149.

Bell, J.A.E.; Stephenson, T.F.; Warner, A.E.M.; Songmene, Victor, "Physical Properties of Graphitic Silicon Carbide Aluminum Metal Matrix Composites", No. 970788, presented at SAE Conference (1997).

*Primary Examiner*—John J. Vrablik

*Attorney, Agent, or Firm*—Harness, Dickey & Pierce, P.L.C.

[57] ABSTRACT

An aluminum alloy scroll machine component having improved lubricity.

26 Claims, 2 Drawing Sheets

COMPOSITE ALUMINUM ALLOY SCROLL MACHINE COMPONENTS

TECHNICAL FIELD

The present invention relates to scroll machines, and particularly scroll machines incorporating composite aluminum alloy scroll machine components.

BACKGROUND AND SUMMARY OF THE INVENTION

Scroll machines derive efficiency and reliability at least in part due to the employment of relatively tight manufacturing tolerances. One way to achieve such tolerances is to use high precision machines and techniques, such as sophisticated (and expensive) numerically controlled machines for machining conventional materials used for scroll machine components. It is thus desirable to use a material that is readily machineable.

One material that popularly has been employed as a scroll machine component material is cast iron. In general, both scroll members of a scroll machine are made from the same material, in order to approximate the same rate of thermal expansion and thereby help reduce the potential for expansion mismatch and associated leakage performance loss. The presence of graphite in at least some cast iron alloys tends to help improve performance by acting as a solid lubricant. The components in turn help form a wear couple for helping to enhance minimizing leakage.

For examples of recent improvements in scroll machine component materials, see, commonly owned U.S. Pat. No. 5,580,401 (Williamson) hereby incorporated by reference.

Though attractive as a relatively high strength to weight material, the use of an aluminum alloy for a scroll machine component material generally has been avoided. Aluminum alloys tend to gall when coupled components wear against each other. In practice, when aluminum alloys have been employed, they have necessitated the undesirable use of sleeve bearings, protective coatings, tip seals, or wear plates between aluminum components.

It is thus an object of the present invention to provide an improved aluminum alloy that can be employed for scroll machine components.

It is a further object of the present invention to provide an improved aluminum alloy that exhibits relatively quick machining times as compared with prior aluminum alloys.

It is a further object of the present invention to provide an aluminum alloy for scroll machine components that exhibits improved wear characteristics as compared with other aluminum alloys.

It is a further object of the present invention to provide an improved aluminum alloy for scroll machine components that obviates the need for sleeve bearings, protective coatings, tip seals, or wear plates between contacting surfaces of other aluminum alloy scroll machine components or of cast iron scroll machine components.

These objects and other advantages are believed obtainable by the subject matter of the present invention, which generally involves the use of an aluminum alloy as a scroll machine component material. In one preferred embodiment, the aluminum alloy employs graphite, which is selectively located at predetermined locations within a scroll machine component. In another preferred embodiment, either with or without graphite in combination with a graphite wetting agent (e.g., nickel coated graphite), the aluminum alloy also incorporates a ceramic reinforcement, preferably aluminum oxide. Other ceramic materials, such as silicon carbide, may optionally be employed.

In yet another preferred embodiment, the graphite and/or ceramic reinforcement are evenly distributed throughout the scroll machine component.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

The description of the general structures of the illustrative scroll components is not intended as limiting. The skilled artisan will appreciate that the components depicted are shown schematically and that variations, modifications and improvements of such structural features are contemplated as within the scope of the present invention. Moreover, the present invention contemplates its usefulness in many different scroll structures, other than those shown.

Figure 1:
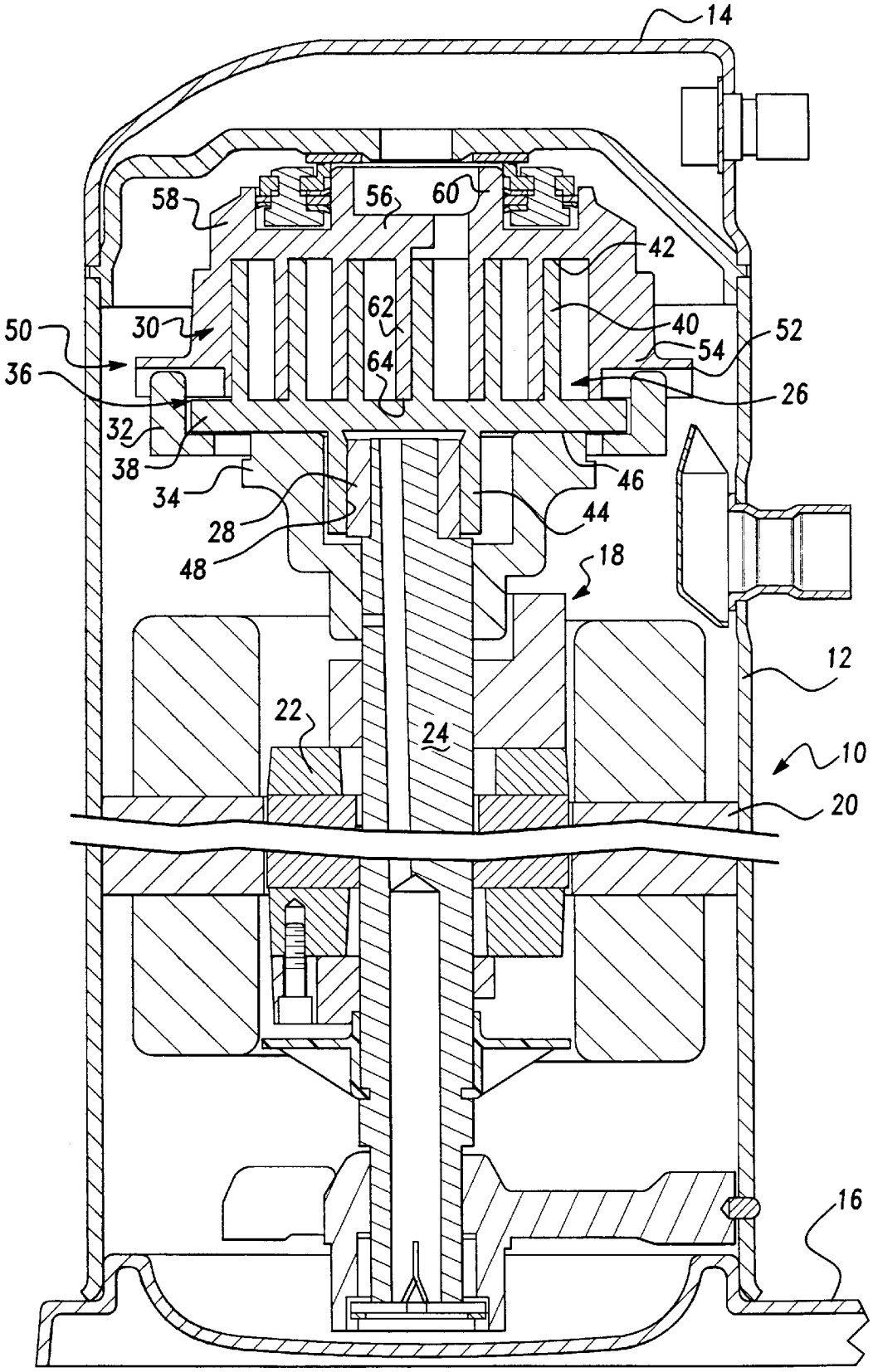
FIG. 1 is a vertical sectional view, with certain parts broken away, of an example of a scroll machine for use with the principles of the present invention, having certain parts slightly rotated for illustration purposes.

The general structure of a scroll machine (e.g., without limitation, a scroll compressor) typically includes a crankshaft operative to drive (e.g., by way of a suitable motor) at least one of a pair of scroll members in relative orbital motion with respect to a second interleaved scroll member. FIG. 1 illustrates the general components of a typical scroll machine 10. There is shown in FIG. 1 a generally cylindrical hermetic shell 12 having a cap 14 at one end and a base 16 at the other. An electric motor 18, including a stator 20 and a rotor 22 connected to a crankshaft 24, drives the crankshaft 24. The crankshaft 24, in turn, is connected to a first scroll member 26. An unloader drive bushing 28 is disposed between the first scroll member 26 and the crankshaft 24. The first scroll 26 is interleaved with a second scroll member 30. An Oldham ring 32 is disposed between the first scroll member 26 and second scroll member 30 to prevent or limit relative rotation of the first scroll member 26 and the second scroll member 30. A main bearing housing 34 is disposed beneath and supports the first scroll member 26.

Figure 2:
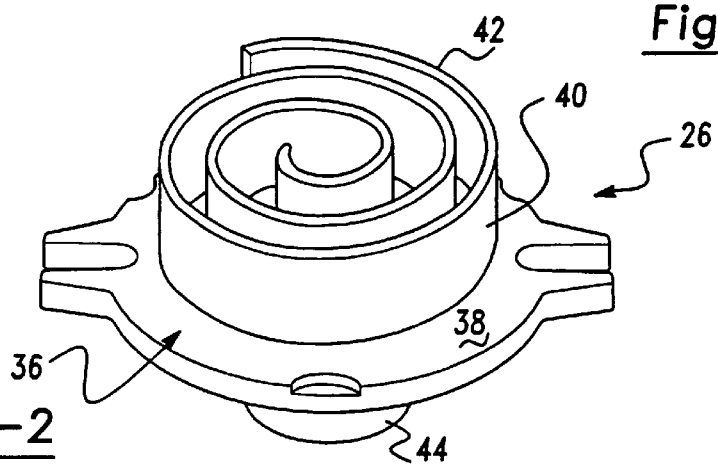
FIG. 2 is a perspective view of a scroll member.

Referring to FIG. 1 and FIG. 2, there is shown an example of the first scroll member 26. The scroll member 26 has a base 36. The base 36 includes a plate 38 defining a surface from which a spiroidal vane 40 extends. The vane 40 terminates at a vane tip 42. A cylindrical hub 44 extends from a surface 46 in a direction away from the spiroidal vane 40. The cylindrical hub 44 has an axial bore 48 defined therein in which is rotatively disposed the unloader bushing 28 having an inner bore structurally defined to engage an end of the crankshaft 24 (such as, for instance, as disclosed on U.S. Pat. No. 4,767,293, hereby incorporated by reference).

FIG. 1 also depicts an example of a suitable second scroll member 30. The second scroll member 30 includes a base portion 50 having a first plate 52, a wall 54 depending from the first plate 52, and a second plate 56. A sealing flange 58 extends away from the second plate 56 about the periphery of the latter. A sealing collar 60 within the sealing flange 58 extends away from the second plate 56. A spiroidal vane 62 extends from a surface of the second plate 56 opposite the surface from which the sealing collar 60 originates. The vane 62 terminates at a vane tip 64.

The scroll compressor components can be employed in coacting combination with one another, as the skilled artisan will appreciate. Examples of representative U.S. Patents illustrating the operation of a scroll compressor and various embodiments and improvements of the same include, without limitation, U.S. Pat. Nos. 4,767,293 and 5,411,384, which are hereby expressly incorporated by reference.

Oldham couplings (such as ring 32) have taken various forms but generally incorporate two pairs of keys 66, with one pair engaging slots in the first scroll member and the other pair engaging either slots in the second scroll member or a stationary body or bearing housing. Of course, variations and improvements of the same exist as demonstrated in, for example (without limitation) U.S. Pat. No. 5,320,506, hereby expressly incorporated by reference.

The present invention involves the incorporation, into a base system for casting aluminum alloy scroll machine components, of a modifier for improving the wear characteristics, the strength or both of the scroll machine components as compared with scroll machine components absent the modifier. In one embodiment, the present invention contemplates adding graphite to the system prior to solidification of molten aluminum alloy. In another embodiment, the present invention contemplates incorporating a ceramic reinforcing material into the base system, either with or without the presence of added graphite. The incorporation of a modifier is particularly preferred for scroll machine components that are in contact with one or more other moving components and are thus potentially more susceptible to wear than other components. Specifically, the present invention finds particular utility for scroll machine parts, such as (without limitation) scroll members, unloader bushings, bearing housings, and devices which prevent or limit relative scroll rotation such as Oldham couplings. Also the composite aluminum alloy may be used to make a preform to be used within a scroll machine component.

The resulting articles of the present invention fall generally within the class of materials known in the art as metal matrix composite materials. There are a number of art disclosed methods for making metal matrix composite materials. The particular technique applied to make the present articles is not critical and may be any suitable technique such as, without limitation, casting (e.g., without limitation, sand casting, semi-solid casting, squeeze casting, investment casting, lost foam casting, continuous casting, die casting, centrifugal casting, or the like, depending on the structure of the final article) by working a bulk structure (e.g., a billet) to the desired configuration using any suitable manufacturing process (e.g., without limitation, coining, drawing, extrusion, forging, stamping, or the like), powder metallurgy, or spray deposition.

In a preferred embodiment of the present invention, the base alloy used to make the scroll machine component is an aluminum alloy. Preferably, when graphite modification only is used, the alloy is adapted from a suitable casting alloy such as, for instance (without limitation), those based on the 3xx.x or 5xx.x (Aluminum Association designation) series of aluminum alloys, specifically the aluminum-silicon (with additional magnesium optional) or aluminum-magnesium casting alloy system, which may contain one or more additional alloying element.

When ceramic reinforcement is used, as described herein, one preferred composite aluminum alloy preferably is based on an aluminum/alumina metal matrix composite material such as Duralcan W6A.xxA (which is based upon a 6061 alloy and is commercially available from Alcan) and may also include a suitable amount of silicon (to improve castability), graphite, its wetting agent or optionally unreinforced aluminum (used as a dilutant).

An alternative method of producing a ceramic reinforced graphite metal matrix composite is to use a 3XX.X or 5XX.X casting alloy as the base alloy, which may also include a suitable amount of silicon (as desired), alumina, graphite and optionally magnesium.

Preferred base alloys generally have a composition comprising some or all of the following (approximate concentrations expressed in percent, by weight of the base alloy composition):

| Element | Concentration |
|---|---|
| Si | up to about 25 |
| Cu | up to about 5 |
| Mg | up to about 11 |
| Zn | up to about 3.0 |
| Ni | up to about 2.5 |
| Fe | up to about 2.0 |
| Mn | up to about 0.6 |
| Cr | up to about 0.4 |
| Sn | up to about .35 |
| Ti | up to about .25 |
| Other | up to about 0.5 total |
| P | up to about 200 ppm |
| Al | balance |

A particularly preferred base alloy (for when graphite only and not a ceramic reinforcement is employed) is aluminum alloy type 390 for the scroll member, type 380 for the Oldham coupling and type 356 for the unloader bushing.

In one of the preferred embodiments, a predetermined amount of graphite is also included in the resulting material. The graphite preferably is provided in particular form. The particulate form is preferably a granular form but flakes may be used in addition to or as an alternative to the granules. Preferably the graphite is coated with a suitable wetting agent, such as nickel (such as is available commercially from suppliers such as INCO; the coated graphite containing up to about 75% by weight nickel) yielding a particle with an average effective graphite particle diameter of up to about 150 microns. In an alternative embodiment, a wetting agent is added directly to the base molten aluminum alloy. While the preferred wetting agent disclosed herein is a nickel containing material (e.g., nickel or a nickel alloy), other suitable wetting agents may be employed as the skilled artisan will appreciate. For instance, a copper containing material (e.g., copper or a suitable copper alloy) may be employed.

Though possible, it is not imperative that the distribution of graphite in the resulting article be uniform. Specifically, the amount of graphite is selected and then introduced to the alloy based on such considerations as desired properties in specific regions of the part and the manufacturing process to be used to make the part. The graphite is present in an amount ranging from about 1 to about 18 volume percent, and more preferably about 4 to about 10 volume percent at least in regions adjacent operative contact surfaces of scroll machine components, and optionally throughout the entire resulting article.

To illustrate, in a particularly preferred embodiment, graphite is added during casting to result in it becoming located in regions at or in close proximity with the surfaces of the scroll components that are subject to the most wear from contact with other components. In this manner, in service, the graphite should effectively provide in situ lubrication to the contact surfaces.

Preferably, the resultant dispersed graphite will be present to an average depth (measured inward from contact surfaces) of at least about 200 microns in the final components. In one preferred embodiment, when a general homogeneous and uniform dispersion of graphite is not obtained, the concentration of graphite should be higher near the contact surfaces than toward the central portions of the sections of the scroll components. In some sections, of course, the graphite depth, the graphite concentration or both may be higher or lower. In another embodiment the graphite may be present throughout an entire section thickness, in either a relatively uniform or nonuniform dispersion and concentration.

By the ability to selectively introduce graphite into the articles of the present invention, it is possible effectively to provide in-situ lubrication to the portions of the article more susceptible to wear, but still maintain strength in portions of the article where wear is less likely a concern (e.g., by limiting the amount of graphite in that region, because of the generally inherent strength reducing characteristics of graphite). Suitable alloying elements optionally may be added to improve strength, nonetheless, including known strengthening elements, such as (without limitation) copper, nickel, magnesium, silicon or the like. Further, it is believed that a suitable wetting agent used with the graphite, preferably nickel, may advantageously react with the aluminum (e.g., when nickel is used to form nickel aluminide ($NiAl_3$, $Ni_2Al_3$)), which may have a strengthening and wear resistance effect on the alloy.

The incorporation of graphite in the articles of the present invention may be accomplished, in one preferred embodiment, by deliberately inducing a concentration gradient. For instance, graphite is known to have a density that is generally lower than the typical elements of suitable aluminum alloy casting materials for the present invention. Thus, regardless of how graphite is introduced into a mold cavity, as the casting cools, the graphite will tend to rise to the top of the cooling article. Accordingly, molds may be designed in a suitable manner so that the portion of the desired resulting article for which graphite is contemplated is oriented upwardly. Moreover, the molds can be designed appropriately so that selective control over cooling rates can be accomplished, such as by conventional foundry practices of adding chill to effect higher cooling rates or insulation to slow cooling rates. Particular preferred casting processes for this technique include processes capable of a generally slow cool, such as (without limitation), conventional sand casting.

Figure 3:
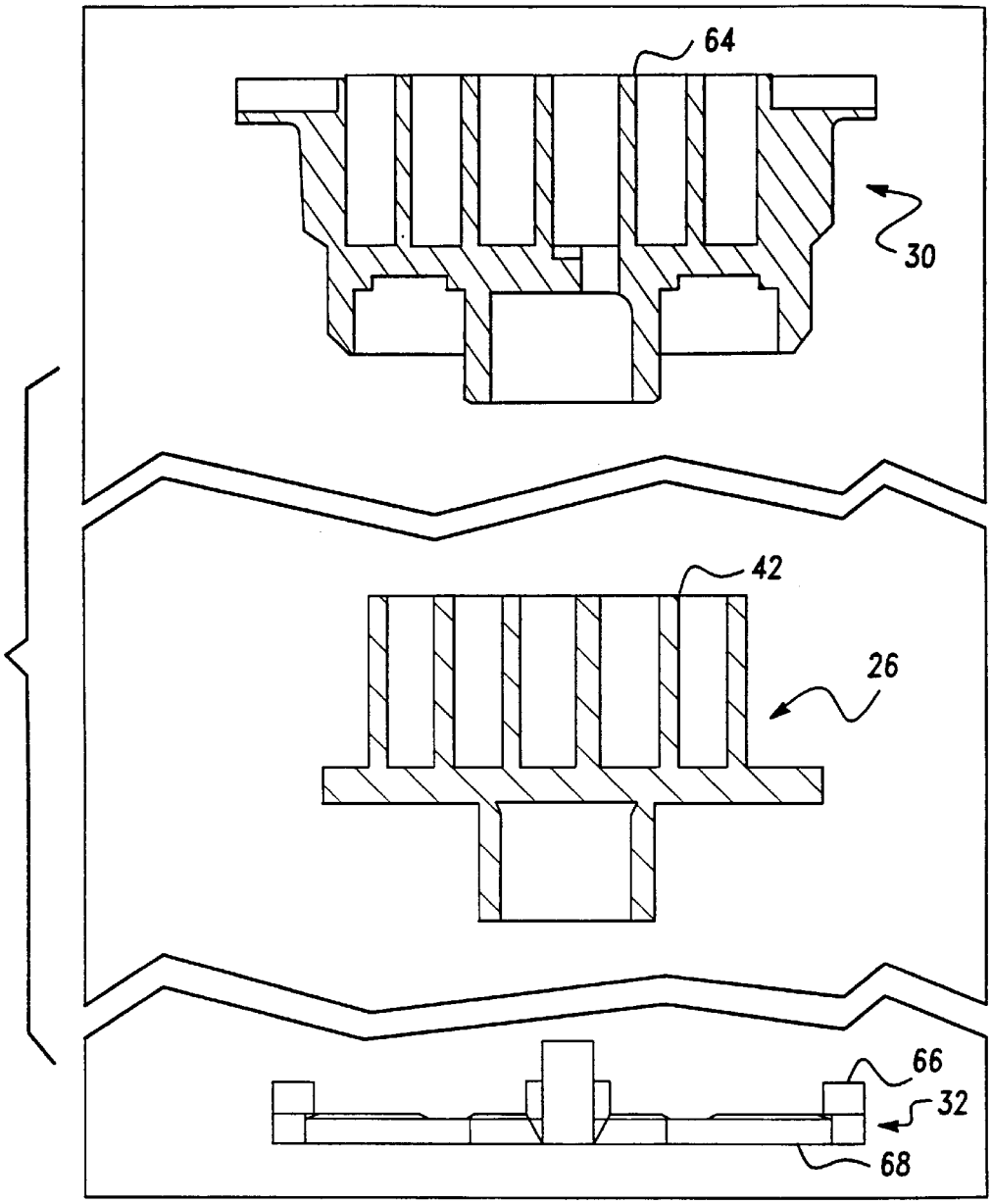
FIG. 3 is a view of certain components of a scroll machine showing orientation of the components as they would be in the immediately as-cast condition for one preferred embodiment of the present invention involving a slow cool casting or a sand casting.

FIG. 3 illustrates preferred part orientations for the casting of a first scroll member 26, a second scroll member 30, and an Oldham ring 32. These components are shown as being cast together at the same time. The skilled artisan will appreciate, however, that they may be cast individually or with other suitable combinations of components. In the orientation shown in FIG. 3, the vane tips 42 and 64 of the scroll members 26 and 30, respectively (which comprise at least part of a contact interface when the scroll members are interleaved during operation), would tend to receive the largest concentration of graphite with their base plates and closely adjacent regions containing a lesser concentration. Each tip-to-base wear interface would then benefit from the graphite in the scroll vane tips. Also the potentially undesirable effects of graphite on the fatigue life of the vane root should tend to be minimized.

Likewise the Oldham ring 32 would contain more graphite in the keys 66, which will contact the scrolls in service, while the ring portion 68 would have less graphite for better load carrying capability.

In another preferred embodiment, such as for die casting processes (where cooling rates tend to be relatively high and there is a greater need to have graphite located proximate to its final desired location), graphite is preferably introduced by the use of a high content graphite-containing preform insert. The preform preferably has the shape of the ultimate desired article (e.g., a scroll), and is placed in the die prior to pouring molten aluminum (having a lower concentration of graphite). The poured metal will infiltrate the preform and fill the die to form the desired resulting article. The faster cooling will tend to confine the graphite in the general vicinity of the preform. While a preform may be made from a variety of processes, preferred methods are powder metallurgy and extrusion. A preferred method of incorporating a journal bearing feature within a bearing housing is by using a composite alloy as a cast-in preform as described herein (e.g., extrusion) in lieu of a bearing sleeve.

In yet another preferred embodiment, centrifugal casting is employed. In such embodiment, as with the embodiment discussed previously (describing utility for generally slower cooling rate techniques, such as sand casting), the graphite is introduced into the molten metal prior to pouring. The centrifuge action of the process should have the effect of distributing the higher density components of the alloy system to the portions of the cast articles that are located generally toward the outermost portions while interior portions, in turn, would benefit from an enrichment of graphite. This should also provide an attractive technique for making bearing housings, whereby graphite would tend to accumulate at or near the bearing surface.

For embodiments in which a generally uniform concentration of graphite is desired (e.g., an unloader bushing), any suitable casting process that would achieve a relatively fast cooling rate may be employed, without any of the above described measures for controlling the graphite distribution (instead allowing the graphite to become generally uniformly dispersed). Alternatively, a billet made by ingot or continuous casting an aluminum casting alloy containing graphite can be used to extrude, forge or semi-solid cast the resulting scroll machine component. One particularly preferred method for making an unloader drive bushing would be to extrude bar stock having a generally uniform distribution of graphite for enhancement of its various wear surfaces.

The above embodiments have contemplated the addition a graphite as a way to modify the characteristics of the resulting material. In yet another preferred embodiment, a reinforcing material (with or without a suitable wetting agent, e.g., without limitation, nickel) is incorporated into the articles of the present invention preferably in addition to, but alternatively in lieu of, the graphite. Specifically, one highly preferred embodiment contemplates articles having graphite selectively located for improved wear resistance, and a ceramic reinforcement, such as aluminum oxide (e.g., without limitation, present in an amount up to about 20 volume percent) selectively located to improve strength characteristics of the base aluminum alloy material. The graphite modification should help improve machinability and wear characteristics of the base aluminum alloy material. The ceramic modification should help improve strength and wear characteristics of the base aluminum alloy material. For instance, the ceramic reinforcement should compensate for or even increase certain mechanical properties of the material as a result of the presence of the graphite. The addition of ceramic reinforcement (e.g., aluminum oxide) is particularly attractive when a uniform dispersion of graphite and ceramic reinforcement is desired. Other ceramic reinforcement may be employed in addition to or in lieu of aluminum oxide such as (without limitation), silicon carbide. Other carbides, oxides or even nitrides may likewise be employed.

Preferably the ceramic reinforcement is denser than the base alloy material, so it will tend to settle to the bottom of a casting of the molten base alloy. This is particularly attractive when graphite is additionally used, and tends to offset the lower density graphite and helps to encourage a relatively uniform distribution in the holding furnace. The preferred ratio of relative volumes of graphite and ceramic reinforcement preferably is such that in the resulting article, when both materials are added to a base material the volume of ceramic reinforcement is up to about 2.5 times the volume of graphite.

Of course, the inclusion of ceramic reinforcement may occur with any of the above methods, with the methods modified as needed to accommodate the ceramic reinforcement. For instance, over time, the relatively high density of ceramic reinforcement tends to cause it to tend to settle toward the bottom of a cooling cast article. Thus, without limitation, the use of the approach discussed previously (e.g., in the context of slower cooling rate techniques, such as sand casting) could advantageously be employed using a ceramic reinforcement (with or without graphite) to achieve improved mechanical characteristics in load bearing regions of the desired article (e.g., without limitation, the base plates and vane roots of the scrolls; or the ring portion of an Oldham ring). The ceramic reinforcement thus will tend to settle toward lower disposed regions of the solidifying part. Thus, it becomes possible to design a concentration gradient or distribution of ceramic reinforcement, graphite or both to, for instance, have graphite located in wear regions and ceramic reinforcement located in regions (such as near plate surfaces (e.g., in vane root regions)) where strength is desired. In an Oldham ring, for instance, there can be more graphite in the key portions, which contact the scrolls in service, while the ring portion will have more ceramic reinforcement for better load carrying capability.

For processing techniques when a preform insert may be employed, such an insert can be selectively designed to incorporate suitable amounts of a ceramic reinforcement (e.g. to result in a concentration in the region generally adjacent the preform in the end product of 0 to about 20 volume percent) along with a suitable amount of graphite to result in a concentration of graphite in the region generally adjacent to the preform in the end product of about 1 to about 18 volume percent.

The ceramic reinforcement (e.g., aluminum oxide) may be provided in any suitable form, for example (without limitation), as a particulate, whisker, or fiber, and more preferably as a particulate. This particulate preferably contains a relatively minimal number of sharp edges, thus tending towards a spheroidal shape and preferably has an average diameter of about 6 to 12 microns. When aluminum oxide is used as the ceramic reinforcement, preferably about 3 to 4% (by weight) magnesium is included in the aluminum alloy in order to help minimize degradation of alumina and improve its wettability.

The skilled artisan will appreciate other adaptations of the above discussed techniques for accommodating the ceramic reinforcement.

The skilled artisan will also appreciate the casting practices available for making the articles of the present invention. Once the mold is filled and all necessary gates, risers, runners, sprues and the pouring cup are in place, molten metal can be poured into the mold. In a preferred embodiment, adequate precaution is used during melt handling (and optionally degassing) to avoid the presence of dissolved gasses in the final casting. When degassing is necessary, caution preferably is exercised to avoid adverse effects to the ceramic reinforcement or graphite dragout. Preferably, the pouring temperature ranges from about 650° C. to about 900° C., and for instance (without limitation) is about 790° C. when 390 aluminum is used as the base alloy, and a die casting process is employed. Higher or lower temperatures are possible depending on such factors as the mass and geometry of the desired scroll machine component, and other considerations that the skilled artisan will appreciate.

When a hypereutectic aluminum base alloy is used, the molten metal may optionally be inoculated during casting using any suitable technique. For example, without limitation, an aluminum alloy may be inoculated with approximately 8% phos-copper shot at about a 0.3% by weight of the molten metal being inoculated. Any suitable inoculation technique may be employed (e.g., in-mold inoculation, ladle inoculation, strainer core or filter inoculation). The preferred primary silicon particle size is about 12.7 to 38.1 microns in mean diameter. With hypoeutectic base aluminum alloys, conventional eutectic modification may be employed to improve the strength, if necessary.

After the material is cast, it is removed from the mold in any suitable manner, taking particular care to avoid rough handling that potentially may cause breakage of the component in view of a potentially reduced ductility of this alloy compared with many conventional alloys. Typical post-casting steps may be employed for steps of ejection, shake out, trimming, or cleaning of the cast articles.

It is also contemplated that the resulting material properties may be enhanced by way of one or more suitable heat treatments. For instance, without limitation, it is possible that known heat treatments, such as T5, T6, or T7 for castings and T8511 for extrusions may be applied to the articles, in the same manner as is now common for conventional aluminum alloys. It is preferable in the case of die casting, in which a near T6 or T7 heat treatment condition is desired, to avoid blistering by employing a suitable cast, quench and age process. For instance, the casting can be quenched immediately upon ejection from the die, and subsequently aged according to a typical T5 process.

Cast articles may be cleaned and finished using conventional techniques such as, without limitation, cutting, grinding and fracturing for removal from the gating system and by shot or abrasive blasting for removal of adhering sand or refractory.

Articles prepared in accordance with the preferred embodiment of the present invention, preferably will be able to function as a wear couple against a similar material without galling at temperatures up to about 450° F. Moreover, the composite material (e.g. for an embodiment that does not include a preform having a relatively high concentration of graphite or ceramic reinforcement; such a ceramic-containing preform may tend to improve the mechanical properties but such a graphite-containing preform may tend to reduce the mechanical properties in the region adjacent the preform) preferably will have a typical hardness ranging from about 60 $H_B$ to about 120 $H_B$ (500 kg). Preferably, the mechanical properties of the material (excluding any preform) will approximate at least about 70% of what the base alloy would exhibit without the presence of the graphite modification or ceramic reinforcement. To illustrate, preferably for a 390 type base aluminum alloy, the resulting material according the present invention will have a tensile strength of at least about 25.2 Ksi (390 aluminum with a T7 treatment; sand cast would generally exhibit an ultimate tensile strength of about 36 Ksi, and a hardness of about 115 $H_B$ (500 kg)). Preferably the material will also exhibit a minimum ultimate tensile strength of approximately 20 Ksi, particularly when employed as a scroll member. (By way of further reference, in instances when graphite is not employed, and the base aluminum alloy is one such as type 356 with a T5 aging (sand cast), the typical hardness would be about 60 $H_B$; for a 390 aluminum aged T5 (die cast), a typical hardness would be about 100 $H_B$).

The resulting articles also preferably have a dynamic coefficient of friction in a region generally adjacent a contact surface of less than about 0.4. Also, in that region, the hardness is at least about 50 $H_B$ (500 kg) and there is an ultimate tensile strength of at least about 10 Ksi.

The resulting microstructure of the materials made in accordance with the present invention, when an alloy such as type 390 aluminum is used as the base alloy, preferably will exhibit a matrix of a hypereutectic aluminum-silicon alloy with a dispersion (which may be generally uniform or selectively located) of one or more subphases which may include graphite, ceramic reinforcement, or a combination of the two. Additionally, it is anticipated that there may be primary silicon particles and eutectic phases commonly found in such aluminum alloy systems.

While the graphite is initially preferably coated with a wetting agent, when the wetting agent is another metal (e.g., nickel), it is anticipated that intermetallic precipitates will form to include that metal and aluminum or other alloying elements in the material (by way of example, it is possible that nickel aluminide will form when nickel coated graphite is employed). Preferably the latter precipitates are uniformly dispersed and are of a size that will not appreciably affect the ductility of the materials.

The employment of relatively fast solidification rates, such as obtained using die casting or lost foam casting methods, may be suitably employed to help preserve the precipitates from the wetting agent or primary silicon in a relatively small size and uniform dispersion. Moreover, it is preferable, for purposes of enhancing machinability and strength of the resulting articles to employ relatively small particle or phase sizes for graphite, eutectic phases, primary silicon phases and ceramic reinforcement that may be present. More preferably, the graphite will have a relatively larger effective diameter than the particulates of other subphases. It is also preferred that the resulting cast articles be substantially free of shrinkage and gas porosity.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine, comprising:

a scroll machine component having a surface for contacting another scroll machine component;

said scroll machine component having more than 2 to about 18% graphite particulate within said aluminum alloy in a region adjacent said surface.

2. A scroll machine according to claim 1, wherein said graphite is uniformly distributed throughout said scroll machine component.

3. A scroll machine according to claim 1, wherein said scroll machine component further comprises a predetermined amount of a ceramic reinforcement within said aluminum alloy.

4. A scroll machine according to claim 3, wherein said ceramic reinforcement is aluminum oxide.

5. A scroll machine according to claim 3, wherein said ceramic reinforcement is uniformly distributed throughout said scroll machine component.

6. A scroll machine, comprising:

a first scroll machine component having a surface for contacting another scroll machine component;

said first scroll machine component being made from an aluminum alloy;

said aluminum alloy including, a) more than 2 to about 18% graphite particulate in a region adjacent said surface;

b) a predetermined amount of a ceramic reinforcement compound.

7. A scroll machine according to claim 6, wherein said graphite particulate is present in an amount of more than 2 to about 18 volume percent in said region adjacent said surface.

8. A scroll machine according to claim 7, wherein said graphite particulate is present in an amount of about 4 to about 10 volume percent in said region adjacent said surface.

9. A scroll machine according to claim 7, wherein said ceramic reinforcing compound is present in the amount of up to about 20 volume percent.

10. A scroll machine according to claim 7, wherein said first scroll machine component is a scroll member.

11. A scroll machine according to claim 7, wherein said first scroll machine component is a member for limiting rotation of a first and second scroll member relative to one another.

12. A scroll machine according to claim 7, wherein said first scroll machine component is an unloader bushing.

13. A scroll machine according to claim 7, wherein said first scroll machine component is a bearing housing.

14. A scroll machine, comprising:

a) a first scroll member; and b) a second scroll member;

said first scroll member and said second scroll member being in contact with each other over at least one contact interface, and at least one scroll member being made from an aluminum alloy, wherein at least one of said first scroll member or said second scroll member has more than 2 to about 18% graphite particulate within said aluminum alloy in a region adjacent said contact interface.

15. A scroll machine according to claim 14, further comprising:

a member operatively disposed relative to said first scroll member for limiting rotation of said first and second scroll members relative to one another, and having a predetermined amount of graphite particulate in an aluminum alloy located in a region adjacent a contact interface.

16. A scroll machine according to claim 14, further comprising an unloader bushing having a predetermined amount of graphite particulate in an aluminum alloy located in a region adjacent a contact interface.

17. A scroll machine according to claim 14, further comprising a bearing housing having a predetermined amount of graphite particulate in an aluminum alloy located in a region adjacent a contact interface.

18. A scroll machine according to claim 14, wherein at least one of said fixed scroll member or said orbiting scroll member has a predetermined amount of a ceramic reinforcement within said aluminum alloy.

19. A scroll machine, comprising:

a scroll machine component having a surface for contacting another scroll machine component;

said scroll machine component being made from an aluminum alloy and having graphite particulate within said aluminum alloy;

said scroll machine component having a dynamic coefficient of friction in a region adjacent said surface less than about 0.4;

said scroll machine component having a hardness in said region adjacent said surface of at least about 50 $H_B$ (500 kg);

said scroll machine component having an ultimate tensile strength in said region adjacent said surface of at least about 10 Ksi.

20. A scroll machine according to claim 19, wherein said scroll member includes a predetermined amount of graphite particulate in said region adjacent said surface.

21. A scroll machine according to claim 20, wherein said scroll member includes more than 2 to about 18 volume percent graphite particulate in said region adjacent said surface.

22. A scroll machine according to claim 21, wherein said scroll member further comprises a predetermined amount of a ceramic reinforcing material.

23. A scroll machine according to claim 22, wherein said scroll member includes up to about 20 volume percent of said ceramic reinforcing material.

24. A scroll machine comprising:

a first scroll machine component having a surface for contacting another scroll machine component;

said first scroll machine component being made from an aluminum alloy and having graphite particulate within said aluminum alloy;

said first scroll machine component having a first coefficient of friction in a region adjacent said surface;

said first scroll machine component having a second coefficient of friction in a region away from said surface that is greater than first coefficient of friction;

wherein said graphite particulate is present in an amount of more than 2 to about 18 volume percent in said region adjacent said surface.

25. A scroll machine according to claim 24, wherein said dynamic coefficient of friction in said region adjacent said surface is less than about 0.4.

26. A scroll machine, comprising:

a scroll member having a plate and a vane extending from said plate, said vane including a root portion that adjoins said plate, and a tip portion that is distal from said plate;

said scroll member being made from an aluminum alloy;

said scroll member further including graphite dispersed in said aluminum alloy in said tip portion;

said root portion having a substantially lesser amount of graphite than said tip portion and also including a ceramic reinforcing material; and said tip portion including a lesser amount ceramic reinforcing material than said root portion.

* * * * *

UNITED STATES PATENT AND TRADEMARK OFFICE

CERTIFICATE OF CORRECTION

PATENT NO. : 6,079,962

DATED : June 27, 2000

INVENTOR(S) : Stephen M. Seibel et al

It is certified that error appears in the above-identified patent and that said Letters Patent is hereby corrected as shown below:

Column 4, line 41, "particular" should be -- particulate --.

Column 6, line 53, "a" (first occurrence) should be -- of --.

Column 9, line 6, after "according" insert -- to --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*